US006553947B2

(12) United States Patent
Bradenbaugh

(10) Patent No.: US 6,553,947 B2
(45) Date of Patent: Apr. 29, 2003

(54) WATER MIXING SYSTEM FOR WATER HEATERS

(76) Inventor: Kenneth A. Bradenbaugh, 10078 Candlestick La., Concord, OH (US) 44070

( * ) Notice: Subject to any disclaimer, the term of this patent is extended or adjusted under 35 U.S.C. 154(b) by 0 days.

(21) Appl. No.: 10/011,599

(22) Filed: Dec. 3, 2001

(65) Prior Publication Data

US 2002/0066419 A1 Jun. 6, 2002

Related U.S. Application Data

(60) Provisional application No. 60/251,190, filed on Dec. 4, 2000.

(51) Int. Cl.[7] ..... F22B 5/04

(52) U.S. Cl. ..... 122/14.3; 122/13.3; 122/4 A; 122/428

(58) Field of Search ..... 122/13.3, 14.3, 122/14.31, 4 A, 429, 428, 405, 380, 381, 382, 383

(56) References Cited

U.S. PATENT DOCUMENTS 2,294,163 A * 8/1942 Donnelly et al. ..... 122/14.31
3,726,475 A * 4/1973 Eising ..... 126/362
4,197,446 A 4/1980 Kalmanoviz et al.
4,632,065 A 12/1986 Kale
4,949,680 A 8/1990 Kale
5,054,437 A 10/1991 Kale
5,137,053 A 8/1992 Kale
5,341,770 A * 8/1994 Lannes ..... 122/383
5,809,941 A 9/1998 Allaire
6,138,614 A * 10/2000 Shropshire ..... 122/380
6,199,515 B1 3/2001 Clarke

FOREIGN PATENT DOCUMENTS

GB 648213 2/1951

* cited by examiner

*Primary Examiner*—Gregory Wilson

(57) ABSTRACT

Disclosed herein are storage type water heaters having means for improved mixing of cold water supply with water stored in the water tank of a water heater, means for limiting surges of water into and out of a water tank, and means for disrupting formation and propagation of convection currents and water streamers in a water tank.

11 Claims, 2 Drawing Sheets

WATER MIXING SYSTEM FOR WATER HEATERS

This application claims the benefit of Provisional application Ser. No. 60/251,190 filed Dec. 4, 2000.

BACKGROUND OF THE INVENTION

1. Field of the Invention

The present invention relates to storage type water heaters. Particularly, the present invention relates to improved apparatus and methods for distributing water in the water storage tank of a water heater for improving thermal efficiency. More particularly, the present invention relates to improved methods and apparatus for mixing incoming cold water with heated water in the water storage tank for eliminating stratification of water according to temperature and for preventing intrusion of cold water streamers into the heated water in the upper portion of the water storage tank.

2. Description of Pertinent Art

Storage type water heaters, as contemplated herein, typically comprise a vertical, cylindrical water rank having a cold water supply tube, (commonly referred to as a "dip tube"), extending internally from the top of the water tank to a point near the bottom of the water rank, and having a hot water outlet near the top of the water tank, Such water heaters may employ gas heat or electrical heat for heating water. Typically, such water heaters are employed to heat cold water from a temperature of often 58° F. or lower to temperatures in the range of about 120° to 140° F. The heated water is stored in the water tank for use as the demand arises.

Such water heaters as are heated by gas generally comprise a vertical, cylindrical water tank having a centrally located gas flue passing vertically through the water tank. A radial flame gas burner, located directly below the bottom of the water tank heats water in the water tank. Additional heat is transferred to water in the water tank from hot combustion gasses produced by the burner passing upward through the gas flue. Flue baffles and similar apparatus are commonly employed in the gas flue for improving heat transfer from the combustion gasses to the water in the tank. Combustion gases are exhausted from the gas flue near the top of the water heater.

Such water heaters as are heated by electricity generally comprise a vertical cylindrical water tank having one or more electrical resistance heating elements mounted at intermediate elevations in the water tank. Heat is exchanged between the heating elements and water in the water tank.

Cold water is supplied to a storage type water heater through a dip tube. As hot water is withdrawn from an outlet near the top of the tank, cold water flows down the dip tube and is deposited near the bottom of the tank. Water in the tank is heated, by either electric elements or gas burners, creating a water temperature gradient with the hottest water near the top of the tank and the coolest water at the bottom. The velocity and uneven distribution of water discharging from the dip tube often result in streamers of cold water flowing upwardly in the tank, disturbing the water temperature gradient and sometimes allowing cold water to discharge from the hot water outlet.

Methods and apparatus for improving distribution of cold water and preventing convection currents of cold water in the tank of a water heater are known in the art. In U.S. Pat. Nos. 4,949,680; 5,054,437; 5,137,053; and 6,199,515 B1, means including baffles and diffusers are provided for distributing cold water from the dip tube evenly across the bottom diameter of the tank and thereby preventing streamers of unheated water from rising within the tank.

In U.S. Pat. No. 4,949,680 the vertical dip tube, through which cold water enters the tank, is positioned at or near the central axis of the tank for exchanging heat between heated water in the tank and cold water entering through the dip tube, thus foiling thermal convection currents from rising in the tank and minimizing the mixing of hot and cold water near the hot water discharge outlet.

U.S. Pat. Nos. 4,632,065 and 5,809,941 disclose internal baffles within the water hearer tank for foiling internal thermal convection currents within the tank and minimizing mixing of hot and cold water near the hot water discharge outlet from the tank.

U.S. Pat. No. 4,197,446 discloses a water heater comprising a storage rank, a cold water inlet means comprising an external water heater connected to the water tank, a jet pump in the cold water inlet and a hot water discharge faucet. In operation, when hot water is discharged through the hot water faucet, cold water enters the tank trough the jet pump, causing water to be drawn from the tank into die external heater where the water is heated to discharge temperature. A portion of the hot water from the external heater is drawn i-nto the jet pump where the hot water mixes with the entering cold water. This water mixture is discharged into the rank where it is maintained at an intermediate temperature without further heating in the tank.

British Provisional Specification GB 648,213 discloses a water heater comprising a tank, a first tube vertically arrayed in the tank and having an open top, an external heater in communication with the external lower portion the first tube, and a second tube having a first open end in communication with the lower portion of the tank and a second open end in communication with the interior of the first tube lower portion. In operation, the external heater heats water in the lower portion of the first tube. As heated water rises in the first tube, cooler water from the lower portion of the water tank is drawn in to the lower portion of the first tube through the open second tube. Heated water from the first tube is discharged near the top of the tank.

SUMMARY OF THE INVENTION

Now, according to the present invention, I have discovered apparatus and methods for improving thermal efficiency and uniformity of hot water discharge temperature in a storage type hot water heater.

A storage type water heater comprising: a water tank having a cold water inlet and a hot water outlet, and a dip tube having a dip tube inlet connected to the cold water inlet, and having a dip tube outlet discharging into the lower portion of the water tank, the improvement of the present invention comprises:

a). a first flow regulator in the cold water inlet for regulating the flow of cold water into the water tank;

b). one or more mixing means in the dip tube for mixing incoming cold water with warm water from the water tank;

c). distributor means for distributing water discharged from the dip tube outlet evenly into the lower portion of the water tank; and d). a second flow regulator in the hot water outlet for regulating flow of hot water from the water heater.

The apparatus of the present invention further includes baffle means in the mid portion of the water tank for preventing the upward flow of cooler water to the hot water outlet.

DETAILED DESCRIPTION OF THE INVENTION

The detailed description of the invention which follows is made with reference to the drawings and in terms of preferred embodiments of the invention. The detailed description is not intended to limit the scope of the present invention, and the only limitations intended are those embodied in the claims appended hereto.

Figure 1:
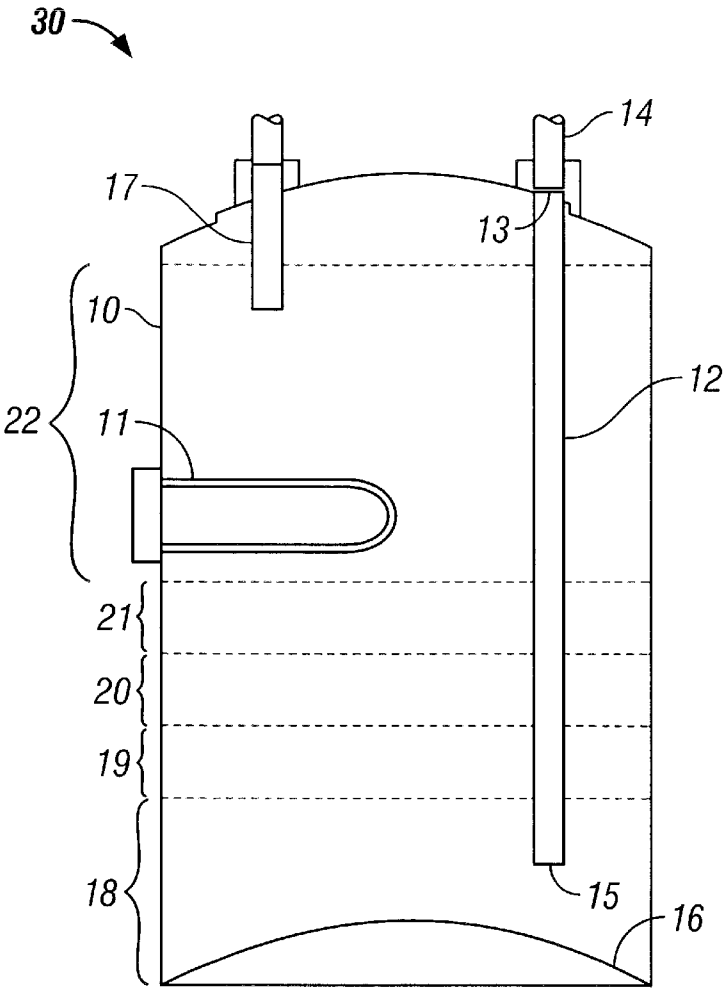
FIG. 1 (Prior Art)
FIG. 1 of the drawings is a schematic cross section of the water tank of an electrically heated water heater typical of prior art storage type water heaters.

In FIG. 1, a conventional water heater is shown and its operation is described below for presenting problems which the improvements of the present invention overcome.

In FIG. 1, a conventional electrically heated tank type water heater 30 is shown in schematic cross section. Water heater 30 comprises a water tank 10 having an electrical resistance heating element 11, a cold water inlet 14 and a hot water outlet 17. A cold water dip tube 12, having an open upper end 13 connected to cold water inlet 14, is disposed substantially vertically in water tank 10 and terminates at open end 15 near the bottom 16 of tank 10. In operation, hot water is withdrawn from water tank 10 via hot water outlet 17. Cold water, propelled by water main pressure, flows into water tank 10 through dip tube 12, replacing the hot water withdrawn. Cold water, from dip tube open end 15, enters the lower portion of water tank 10 near water tank bottom 16. The velocity and uneven distribution of cold water flowing from dip tube open end 15 creates streamers of cooler water which are forced upward, creating volumes of water having different temperatures. The volumes of water having different temperatures form water strata, indicated at 18, 19, 20, 21 and 22, in water tank 10. Each water stratum, of 18, 19, 20, 21 and 22, has a different temperature and density from other strata of the group. The temperatures of the strata increase in a vertical direction with stratum 18 having the lowest temperature and stratum 22 having the highest temperature. Water in stratum 22, heated by heating element 11, is substantially at the temperature of hot water which is withdrawn through hot water outlet 17.

As the rate of hot water withdrawal from hot water outlet 17 is increased, the rate of cold water flowing from dip tube outlet 15 increases for maintaining the volume of water in water tank 10. At high rates of flow, cold water from dip tube outlet 15 tends to force water from strata 18 and 19 upward into water stratum 22 and, in severe cases, into hot water outlet 17. Thus reducing the temperature of hot water available for withdrawal from water tank 10.

According to the present invention, apparatus and methods for improved distribution of cold water into a storage type water heater are disclosed. Use of the apparatus and methods of the present invention improves mixing of cold supply water with water in the water tank of the water heater, thereby minimizing temperature stratification of water in the water tank and reducing intrusion of cooler water from the water tank into the hot water outlet; thereby improving thermal efficiency of the water heating process and improving uniformity of the temperature of hot water produced.

Figure 2:
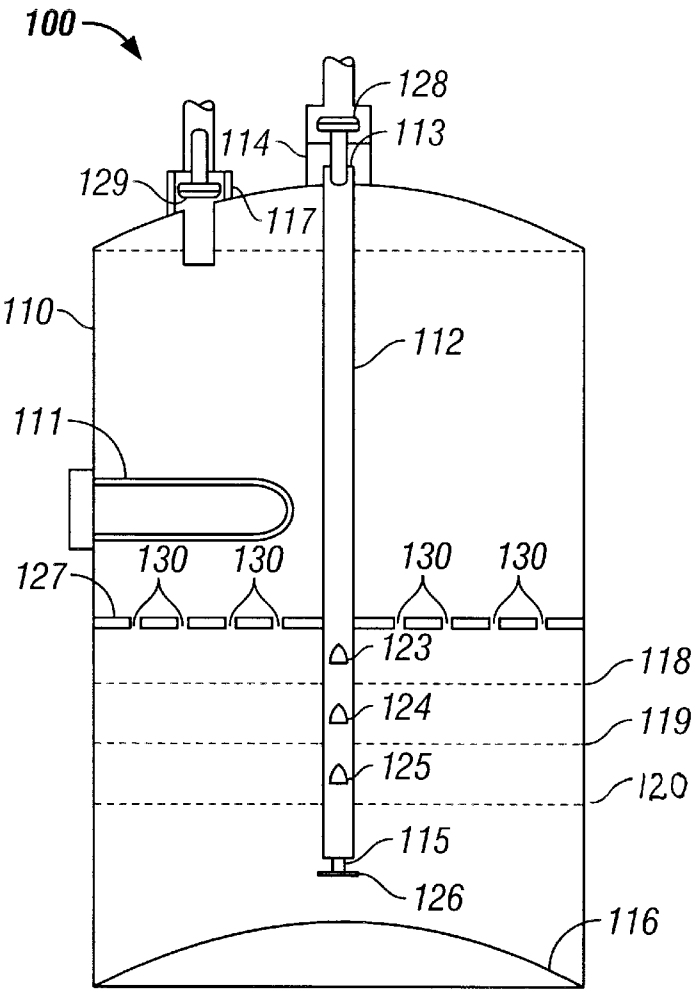
FIG. 2 of the drawings is a schematic cross section of the water tank of an electrically heated storage type water heater, incorporating improvements of the present invention.

In FIG. 2, a water heater 100, embodying improvements of the present invention is shown. Water tank 110, having an electrical resistance heating element 111, is shown in schematic cross section. Cold water dip tube 112, having an open upper end 113 connected to cold water inlet connection 114 near the top of water tank 110, extends downward into water tank 110, ending at dip tube open end 115 above water tank bottom 116. Hot water outlet 117 is located near the top of water tank 110.

In FIG. 2, according to the present invention, eductor mixers 123, 124 and 125 are connected into the lower portion of dip tube 112, for blending water from water tank 110 with cold water in dip tube 112. Eductor mixers are well known and widely used for pumping and mixing liquids. Eductor mixers utilize the kinetic energy of a first flowing liquid to cause a second liquid to flow into and mix with the first liquid. In operation, a high velocity stream of one liquid exiting a restricted flow area creates an region of low pressure into which a second liquid can flow, thus mixing the two liquids.

In FIG. 2, cold water flowing in dip tube 112 passes through eductor mixer 123 thus drawing in and mixing warm water from water tank 110 with cold water in dip tube 112, thereby forming a first water mixture having a temperature higher than the cold water temperature. This first wager mixture continues flowing downward from eductor mixer 123, through dip tube 112 and through eductor mixer 124, thus drawing in and mixing additional warmer water from water tank 110 to form a second water mixture, warmer than the first water mixture. The second water mixture Continues flowing downward from eductor mixer 124, through dip tube 112 and through eductor mixer 125 where the second water mixture draws in and mixes with further warm water from water tank 110, thus forming a third water mixture which is warmer than the second water mixture. This third water mixture continues flowing down dip tube 112, through dip tube outlet 115 and discharges into the lower portion of water tank 110. By placing eductor mixers 123, 124 and 125 in the lower portion of water tank 110 below heating element 111, water strata 119, 120 and 218, each having a different temperature, are disrupted or prevented from forming, such that water in the lower portion of water tank 110 has a relatively uniform temperature as it passes upward for heating by the electrical heating element 111. Thereby allowing hot water to be heated to a relatively uniform temperature and improving thermal efficiency of the water heating process.

In FIG. 2, the three eductor mixers 123, 124 and 125 are shown in the lower portion of water tank 110. Preferably the eductor mixers are positioned in the lower third of water tank 110 where water strata, such as strata 118, 119 and 120 are likely to form when such eductor mixers are not employed. While three eductor mixers, 123, 124 and 125, are shown, it is contemplated that the number of eductor mixers may be selected to achieve the desired mixture of incoming cold water with warm water from water tank 110. The number of eductor mixers may be one or more.

In FIG. 2, a distributor 126 is located below dip tube outlet 115 for redirecting the flow of water from dip tube outlet 115 from a downward direction to a substantially horizontal direction and for distributing the redirected water into water contained in the lower portion of water tank 110.

Distributor 126, by so distributing the water flowing from dip tube outlet 115, improves mixing of water flowing from dip tube outlet 115 with water in the lower portion of tank 110; reduces formation of water strata having different temperatures; and reduces the up flow of cooler water into hotter water located in the upper portion of water tank 110. Distributor 126 comprises means for changing the direction of water flow from a downward direction at dip tube outlet 115 to a substantially horizontal direction. In FIG. 2, distributor 126 is shown connected to dip tube outlet 115. However, distributor 126 may be mounted in other ways, such as connected to a wall or bottom 116 of water tank 110.

In FIG. 2, dip tube 112 is connected to cold water inlet 114 and extends downward into water tank 110. Eductor mixers 123, 124, and 125 and distributor 126 are shown connected to dip tube 112. Preferably, dip tube 112, eductor mixers 123, 124 and 125 and distributor 126 are of a dimension such that they will pass through cold water inlet 114. In this preferred configuration, dip tube 112, eductor mixers 123, 124 and 125 and distributor 126 may be freely passed through cold water inlet 114 for insertion into and withdrawal from water tank 110 as necessary or as desired.

In FIG. 2, baffle 127 extends horizontally across water tank 110 at an elevation above eductor mixer 123 for preventing the up flow of streams of cooler water into the upper portion of water tank 110 near hot water out let 117 without substantially hindering the general upward flow of water from the lower portion into the upper portion of water tank 110. Preferably, baffle 127 is located at about the mid point of water tank 110. Openings 130 in baffle 127 are arranged such that streams of rising cooler water will be disrupted while the upward movement of water from the lower portion into the upper portion of water tank 110 is not substantially hindered. Baffles are well known and widely used. Baffle 127 may have a variety of configuration for accomplishing its purpose in the present invention. For example, baffle 127 may comprise a horizontal plate having holes or openings 130, wherein the horizontal plate disrupts the upward flow of relatively fast moving streams of cooler water and the openings 130 allow the generally upward flow of water from the lower to the upper portion of water tank 110.

In FIG. 2, first flow regulator 128 is connected to cold water inlet 114 and to dip tube open upper end 113. Flow regulator 128 regulates the rate of flow of cold water into water tank 110. Flow regulator 128 limits the rate of flow of cold water and limits a surge of cold water into water tank 110 when a sudden pressure change in the water system associated with the water heater 100 occurs. Such pressure changes in the water system often occur when a valve in the water system is suddenly opened or closed. By limiting a sudden surge of cold water into water tank 110, an upsurge of cooler water from the lower portion into the upper portion of water tank 110 is prevented.

In FIG. 2, a second flow regulator 129 is connected to hot water outlet 117 for regulating the rate of flow of hot water out of water tank 110 for limiting a surge of hot water when a sudden pressure change in the water system associated with water heater 100 occurs. By limiting a surge of hot water from water tank 110, the opportunity for injury or discomfort to a user of the hot water is decreased.

A wide variety of apparatus are available for use as flow regulators 128 and 129. For example, orifice plates, check valves, and spring activated flow regulator valves are well known and widely used for such purposes. The choice of apparatus will depend upon such factors as anticipated pressure changes and water flow rates which the flow regulators may be expected to experience. One preferred apparatus is a spring activated flow regulator valve which is normally closed and opens in response to an increase in pressure differential across the valve. The spring limits the rate and degree of opening of the regulator valve in response to a pressure differential across the regulator valve, thus limiting any surge of water through the regulator valve. Such flow regulator valves are widely commercially available in a wide variety of styles, sizes, flow capacities and pressure differentials.

The description of the invention given above and with reference to FIG. 2 of the drawings is given in terms of an electrically heated water heater. A gas heated water heater has different thermodynamic characteristics from an electrically heated water heater. These differences in thermodynamic characteristics result in different heat distributions within the water contained in a water tank. Consequently, a different arrangement of the dip tube-eductor mixer combination is desirable for gas heated water heaters , as compared to electrically heated water heaters. Other elements of the present invention, including distributor 126, baffle 127 and flow regulators 128 and 129 have the same functions in both electrically heated and gas heated water heaters. Therefore, in the description of the present invention which follows, as it applies to gas heated water heaters, only the dip tube-eductor mixer combination is described with the understanding that distributor 126, baffle 127 and flow regulators 128 and 129 may be used in the same way in both electrically heated and in gas heated water heaters.

Figure 3:
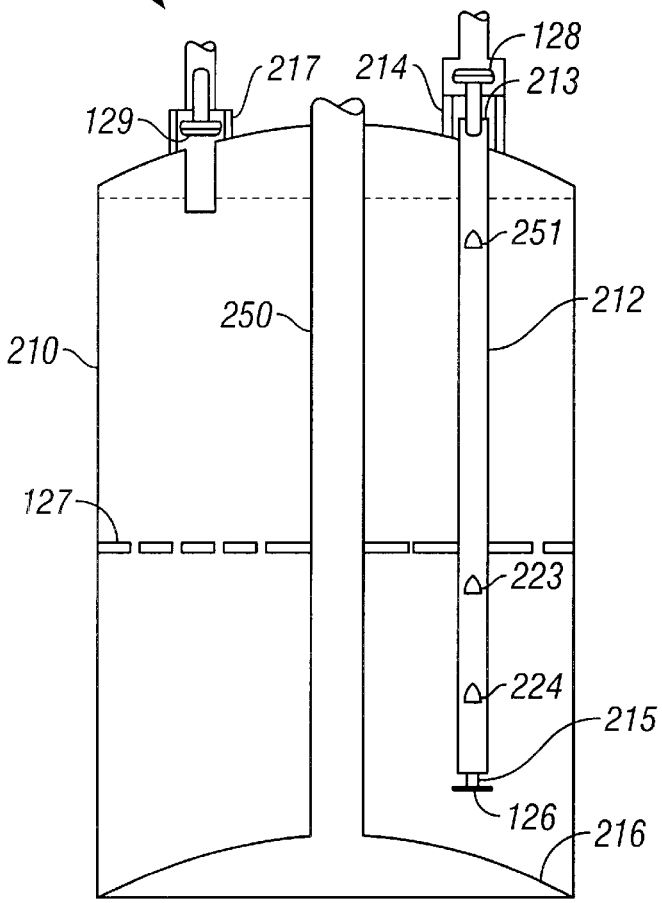
FIG. 3 of the drawings is a schematic cross section of the water tank of a gas flame heated storage type water heater, incorporating improvements of the present invention.

FIG. 3 is a schematic cross section of a water tank 210 of a gas heated water heater 200. In FIG. 3, gas flue 250 extends upward through the center of water tank 210 for exhausting combustion gas from a gas burner, not shown, which heats water in water tank 210. Hot combustion gasses in gas flue 250 often heat water near the top of water tank 210 to temperatures in excess of the maximum desired hot water temperature. Such overheating of water results in a waste of thermal energy.

In FIG. 3, dip tube 212, having an open upper end 213 connected to cold water inlet connection 214 near the top of water tank 210. extends downward into water tank 210, ending at dip tube open end 215, above water tank bottom 216. Hot water outlet connection 217 is located near the top of water tank 210. Cold water flows from dip tube 212 and enters water tank 210 through dip tube open end 215. Eductor mixer 251 is connected in dip tube 212 at an elevation near the top of water tank 210 and eductor mixers 223 and 224 are connected in dip tube 212 at elevations in the lower portion of water tank 210 for blending water from tank 210 wit cold water flowing through dip tube 212.

In FIG. 3, eductor mixer 251 is positioned in the upper portion of dip tube 212 for drawing in and mixing hot water from near the top of water tank 210 with cold water in dip tube 212 thereby forming a first water mixture having a temperature intermediate between the cold water temperature and the hot water temperature, thereby substantially redistributing wasted thermal energy from overheated water into water in the lower portion of water tank 210

In FIG. 3, the first water mixture flows downward from eductor mixer 251 through dip tube 212 and through eductor mixer 223, thus drawing in and mixing warm water from the lower portion of water tank 210 for forming a second water mixture having a temperature higher than the temperature of the first water mixture. This second water mixture flows downward from eductor mixer 223, through dip tube 212 and through eductor mixer 224 where the second water mixture draws in and mixes with additional water from water tank 210, forming a third water mixture which is generally warmer than the second water mixture. The third water mixture flows downward from eductor mixer 224 through dip tube 212 to dip tube lower end 215 from which the third water mixture is discharged into water tank 210. Eductor mixers 223 and 224, by drawing in water from the lower portion of water tank 210, disrupt and prevent formation of water strata of different temperatures in the lower portion of water tank 210.

Figure 4:
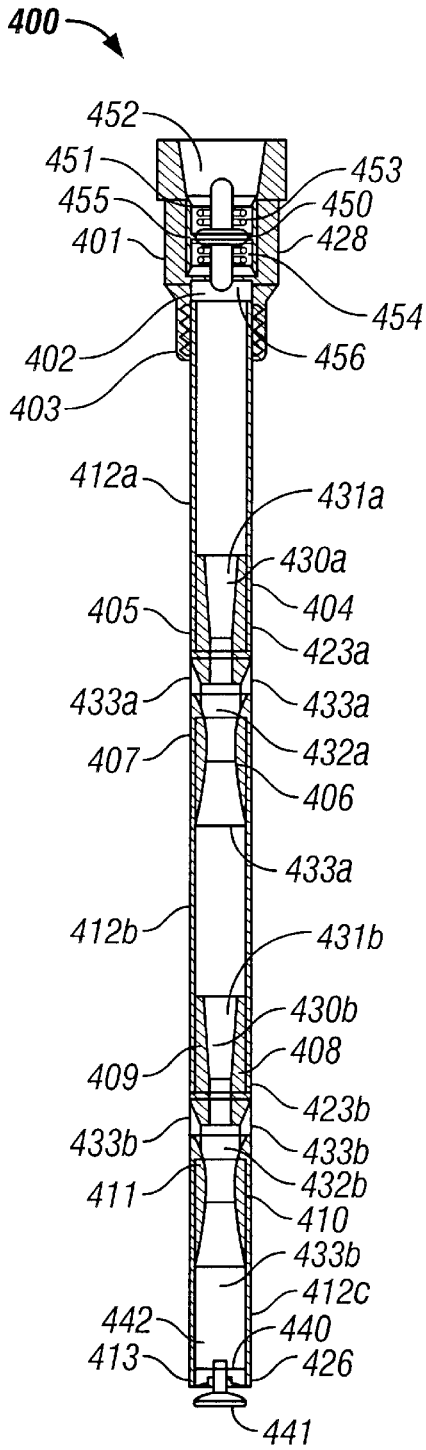
FIG. 4 of the drawings is a schematic cross section of a dip tube assembly incorporating the improvements of the present invention.

In FIG. 4, a dip tube assembly 400 is shown in section view. dip Tube assembly 400 comprises tubular dip tube members 412*a*, 412*b* and 412*c*, eductor mixers 423*a* and 423*b*, distributor 426 and flow regulator 428. Dip tube assembly 400 is designed for insertion into a water tank through a cold water inlet.

In FIG. 4, flow regulator housing 401 is connected to the open upper end 402 of firs: dip tube member 412*a* and threads 403 provide for releasable connection of. flow regulator housing 401 to a cold water inlet of a water tank. Dip tube members 412*a*, 412*b* and 412*c*, eductor mixers 423*a* and 423*b* and distributor 426 will pass freely through the cold water inlet and into the water tank.

In FIG. 4, Flow regulator 428 is double acting for limiting the flow of water surges in either direction through flow regulator 428. Flow regulator 428 comprises regulator valve body 451 contained within the interior of flow regulator housing 428. Openings 452 and 456 provide communication through regulator valve body 451. Regulator valve plunger 450 is moveably mounted within regulator valve body 451. Spring 453 communicates between the upper surface of regulator valve plunger 450 and regulator valve body 451, and spring 454 communicates between the lower surface of regulator valve plunger 450 and regulator valve body 451 for maintaining regulator valve plunger in contact with regulator valve seat 455 under conditions of no differential pressure across flow regulator 428. Upon application of a differential pressure across flow regulator 428, springs 453 and 454 resist displacement of regulator valve plunger away from regulator valve seat 455, thus limiting any surge at water passing in either direction through flow regulator 428.

In FIG. 4, upper end 404 of first eductor mixer 423*a* is connected to lower open end 405 of first dip tube member 412*a*. Lower end 406 of first eductor mixer 423*a* is connected to open upper end 407 of second dip tube member 412*b*. Upper end 408 of second eductor mixer 423*b* is connected to lower open end 409 of second dip tube member 412*b* and lower end 410 of second eductor mixer 423*b* is connected to open upper end 411 of third dip tube member 412*c*.

In FIG. 4, central opening 430*a* through first eductor mixer 423*a* smoothly reduces in diameter from central opening inlet 431*a* to central opening mid point 432*a* and smoothly decreases in diameter from central opening mid point 432*a* to central opening outlet 433*a*. Openings 433*a* provide communication between the exterior of dip tube assembly 400 and central opening midpoint 432*a*. Likewise, the diameter of central opening 430*b* smoothly decreases from central opening inlet 431*b* to central opening mid point 432*b* and smoothly increases in diameter from central opening mid point to central opening outlet 433*b*, and openings 433*b* provide communication between the exterior of dip tube assembly 400 and central opening mid point 432*b* of second eductor mixer 423*b*.

As water flows through the central opening of an eductor mixer as described above, the velocity of the flowing water increases as the diameter of the eductor mixer central opening decreases and the velocity of flowing water then decreases as the diameter of the central opening increases. In the dip tube assembly described, as the velocity of flowing water increases, the pressure of the flowing water decreases, thus producing a pressure differential between the exterior of the dip tube assembly and the interior of the eductor mixer central opening. Water, under influence of the pressure differential, flows through the openings between the exterior of the dip tube assembly into the eductor mixer central opening mid point.

In FIG. 4, distributor 426 comprises a distributor housing 440 connected to third dip tube member lower end 413 and a distributor plate 441. Openings 442 through distributor housing 440 provide communication between the interior of third dip tube member 412*c* and the exterior of dip tube assembly 400. Distributor plate 441 is connected to and spaced below distributor housing 441 for radially deflecting water flowing from distributor housing openings 442.

Dip tube assembly 400, described above, may be releasably connected into a water tank such that water flowing through the dip tube assembly 400 is mixed with water present in the water tank and water flowing from the dip tube assembly 400 is radially distributed into the water tank.

While the present invention has been described with reference to preferred embodiments, the same are to be considered illustrative only and not limiting in character. Many modifications to the methods and apparatus of the present invention will occur to those skilled in the art without departing from the spirit and scope of the invention, which is defined only by the claims appended hereto.

I claim and wish to protect by Letters Patent:

1. In a storage type water heater for operation in a water system having a positive pressure and comprising a water tank having a wall, a top and a bottom defining a water tank interior for storing a volume of water, a hot water outlet connected near the water tank top for passage of water withdrawn from the water tank, a cold water inlet connected to the water tank top for passage of water into the water tank, and a dip tube having a first open end in communication with the cold water inlet and a second open end terminating above the water tank bottom, wherein, upon withdrawal of water from the water tank through the hot water outlet, a stream of water flows through the cold water inlet into the dip tube first open end and out the dip tube open second end into a lower portion of the water tank for maintaining the volume of water in the water tank; the improvement comprising:

a first eductor mixer connected in the dip tube between the dip tube first open end and the dip tube second open end and in communication with the water tank interior for mixing a portion of the volume of water from the water tank with the stream of water flowing through the dip tube; and a baffle horizontally disposed within the water tank interior between the water tank top and the water tank bottom for dividing the volume of water into a portion below the baffle and a portion above the baffle and for limiting formation of water streamers and convection currents within the volume of water and allowing upward passage of water from the portion of water below the baffle into the portion of water volume above the baffle.

2. The water heater of claim 1, including: the first eductor mixer connected in the dip tube at an elevation above the baffle for mixing a portion of the water volume above the baffle into the water volume below the baffle.

3. The water heater of claim 2, including:

a second eductor mixer connected in the dip tube at an elevation below the baffle for mixing a portion of the water volume below the baffle with water flowing in the dip tube.

4. The water heater of claim 1, including;

the first eductor mixer connected in the dip tube at an elevation below the baffle for mixing a portion of the water volume below the baffle with water flowing in the dip tube.

5. In a storage type water heater for operation in a water system having a positive pressure and comprising a water tank having a wall, a top and a bottom defining a water tank interior for storing a volume of water, a hot water outlet connected near the water tank top for passage of water withdrawn from the water tank, a cold water inlet connected to the water tank top for passage of water into the water tank, and a dip tube having a first open end in communication with the cold water inlet and a second open end terminating above the water tank bottom, wherein, upon withdrawal of water from the water tank through the hot water outlet, a stream of water flows through the cold water inlet into the dip tube first open end and out the dip tube open second end into a lower portion of the water tank for maintaining the volume of water in the water tank; the improvement comprising:

a first eductor mixer connected in the dip tube between the dip tube first open end and the dip tube second open end and in communication with the water tank interior for mixing a portion of the volume of water from the water tank with the stream of water flowing through the dip tube; and a first flow regulator connected to the cold water inlet and in communication with dip tube first open end for limiting a surge of water into the water tank through the cold water inlet upon a surge in the water system pressure.

6. The water heater of claim 5, including:

a second water regulator connected to the hot water outlet for limiting a surge of water from the water tank hot water outlet upon a surge in the water system pressure.

7. The water heater of claim 6, including:

the first water regulator for limiting a surge of water into or out of the water tank through the cold water inlet upon a surge in the water system pressure.

8. A dip tube assembly for supplying water through a cold water inlet into a water tank of a storage type water heater, the dip tube assembly having an exterior for contact with water contained in the water tank and an interior for passing a flow of water into the water tank, the dip tube assembly further comprising:

a). a flow regulator comprising: a flow regulator body having a flow regulator inlet and a flow regulator outlet; and flow regulator means contained within the flow regulator body for limiting water surges into the dip tube assembly;

b). means for releasably connecting the flow regulator outlet into the cold water inlet of the water tank;

c). a first dip tube member having a first dip tube member inlet releasably connected to the flow regulator and a first dip tube member outlet;

d). a first eductor mixer for mixing water flowing in the dip tube assembly with a portion of the water from the water tank and having a first eductor mixer first inlet connected to the first dip tube member outlet, a first eductor mixer second inlet communicating between the dip tube member exterior and the dip tube assembly interior for passage of water from the water tank into the interior of the dip tube assembly, and a first eductor mixer outlet; and e). a second dip tube member having a second dip tube member inlet connected to the first eductor mixer outlet and having a second dip tube member outlet in communication with the water tank interior.

9. The dip tube assembly of claim 8, including a plurality of dip tube members and a plurality of eductor mixers in communication for mixing water from the water tank with water flowing in the dip tube assembly.

10. The dip tube assembly of claim 8, including:

a distributor in communication with the second dip tube member outlet for redirecting water flowing from the second dip tube member outlet from a downward direction to a substantially horizontal direction and for distributing the redirected water into the lower portion of the water tank.

11. The dip tube assembly of claim 8, including a plurality of dip tube members and a plurality of eductor mixers in communication for mixing water from the water tank with water flowing in the dip tube assembly.

* * * * *